US011268328B2

(12) United States Patent
Yang et al.

(10) Patent No.: US 11,268,328 B2
(45) Date of Patent: Mar. 8, 2022

(54) DOUBLE-WALLED DRILL PIPE AND DRILLING MACHINE

(71) Applicant: XUZHOU XUGONG FOUNDATION CONSTRUCTION MACHINERY CO., LTD., Xuzhou (CN)

(72) Inventors: Ming Yang, Xuzhou (CN); Weixiang Lv, Xuzhou (CN); Lihua Han, Xuzhou (CN); Ming Li, Xuzhou (CN); Tao Ma, Xuzhou (CN); Feng Cao, Xuzhou (CN); Kuankuan Li, Xuzhou (CN)

(73) Assignee: XUZHOU XUGONG FOUNDATION CONSTRUCTION MACHINERY CO., LTD., Xuzhou (CN)

( * ) Notice: Subject to any disclaimer, the term of this patent is extended or adjusted under 35 U.S.C. 154(b) by 0 days.

(21) Appl. No.: 17/279,615

(22) PCT Filed: Jul. 25, 2019

(86) PCT No.: PCT/CN2019/097784
§ 371 (c)(1),
(2) Date: Mar. 25, 2021

(87) PCT Pub. No.: WO2020/063079
PCT Pub. Date: Apr. 2, 2020

(65) Prior Publication Data

US 2021/0310315 A1 Oct. 7, 2021

(30) Foreign Application Priority Data

Sep. 25, 2018 (CN) ..... 201811113016.8

(51) Int. Cl.
*E21B 17/00* (2006.01)

(52) U.S. Cl.
CPC ..... *E21B 17/00* (2013.01)

(58) Field of Classification Search
CPC ..... E21B 17/00; E21B 17/203
See application file for complete search history.

(56) References Cited

U.S. PATENT DOCUMENTS 2,663,545 A * 12/1953 Grable ..... E21B 33/12 166/264
3,680,631 A * 8/1972 Allen ..... F16L 1/026 166/57

(Continued)

FOREIGN PATENT DOCUMENTS

CN 203374213 U 1/2014
CN 204729017 U 10/2015

(Continued)

*Primary Examiner* — D. Andrews
*Assistant Examiner* — Ronald R Runyan
(74) *Attorney, Agent, or Firm* — Bayramoglu Law Offices LLC

(57) ABSTRACT

A double-walled drill pipe includes an outer drill pipe, an inner drill pipe and a drill pipe sealing apparatus. The outer drill pipe includes an axial through hole and a wall surface through hole, and the wall surface through hole is disposed in a wall surface of the outer drill pipe to connect the outside of the double-walled drill pipe and the axial through hole. The inner drill pipe is rotatably disposed in the axial through hole, and includes a fluid guiding hole connected to the wall surface through hole. The drill pipe sealing apparatus is disposed between the outer drill pipe and the inner drill pipe. The drill pipe sealing apparatus is axially located between a driving end and a connecting port of the wall surface through hole connected to the axial through hole. A drilling machine including the double-walled drill pipe is also provided.

19 Claims, 1 Drawing Sheet

(56) References Cited

U.S. PATENT DOCUMENTS

| | | | | | |
|---|---|---|---|---|---|
| 4,691,790 | A * | 9/1987 | Reichman | E21B 7/18 | 175/67 |
| 5,186,266 | A * | 2/1993 | Heller | E21B 10/04 | 175/215 |
| 6,167,975 | B1 * | 1/2001 | Estes | E21B 10/18 | 175/331 |
| 2007/0227779 | A1 * | 10/2007 | Swinford | E21B 4/02 | 175/71 |
| 2009/0289453 | A1 * | 11/2009 | Sauer | F16L 29/007 | 285/383 |
| 2010/0319995 | A1 * | 12/2010 | Johnson | E21B 21/00 | 175/57 |

FOREIGN PATENT DOCUMENTS

| | | | | |
|---|---|---|---|---|
| CN | 204754797 | U | 11/2015 | |
| CN | 107724968 | A | 2/2018 | |
| CN | 108894733 | A | 11/2018 | |
| CN | 208870542 | U | 5/2019 | |
| DE | 102007051436 | A1 * | 4/2009 | F16L 15/003 |
| EP | 0031125 | A1 | 7/1981 | |

* cited by examiner

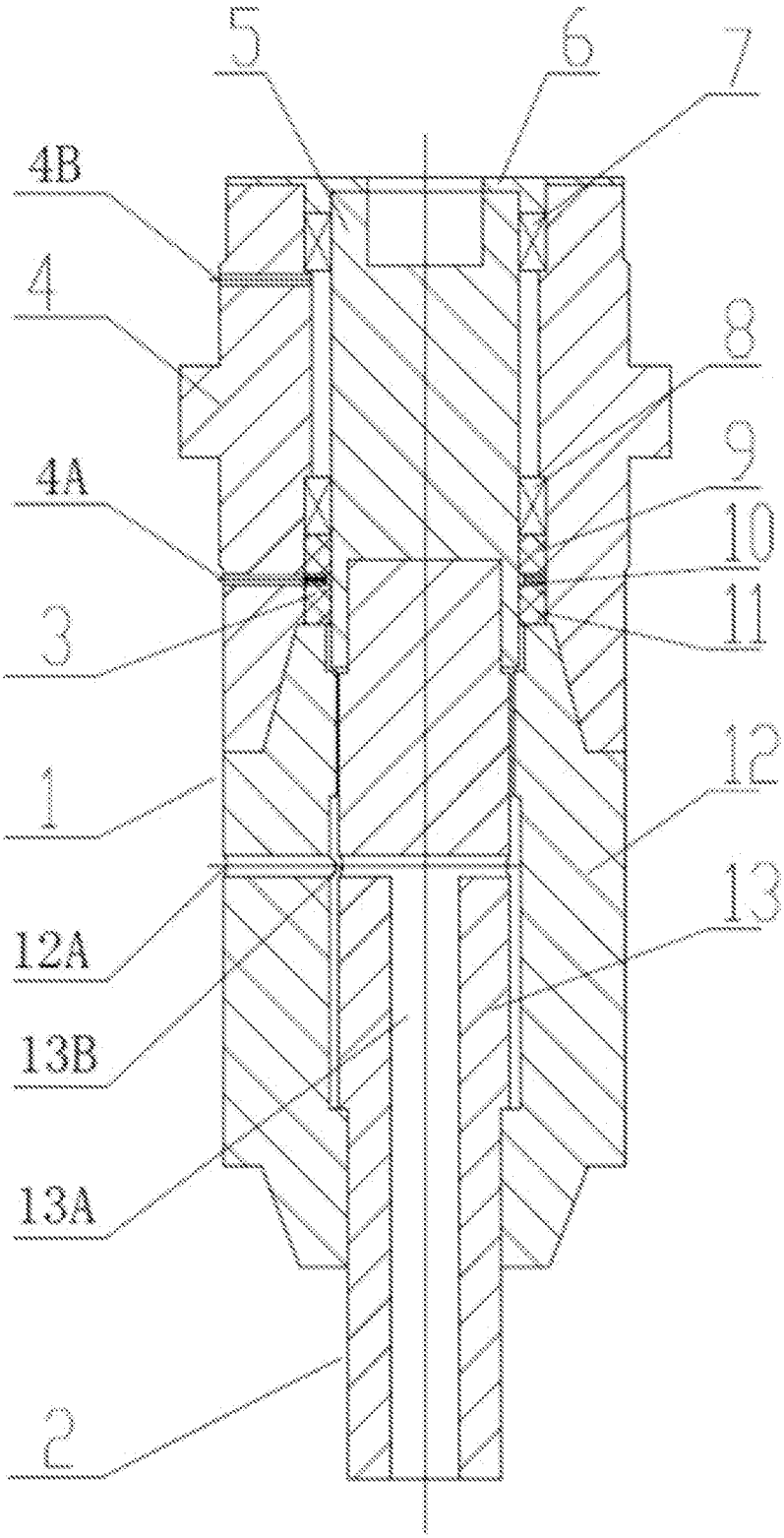
5
6
7
4B
4
8
9
4A
10
3
11
1
12
12A
13
13B
13A
2

DOUBLE-WALLED DRILL PIPE AND DRILLING MACHINE

CROSS REFERENCE TO THE RELATED APPLICATIONS

This application is the national phase entry of International Application No. PCT/CN2019/097784, filed on Jul. 25, 2019, which is based upon and claims priority to Chinese Patent Application No. 201811113016.8, filed on Sep. 25, 2018, the entire contents of which are incorporated herein by reference.

TECHNICAL FIELD

The present invention relates to the field of construction machinery, and more particularly, to a double-walled drill pipe and a drilling machine.

BACKGROUND

Drilling machines using a double-walled drill pipe for drilling have been proposed in the prior art. Such machines can realize rapid drilling, but they have a high failure rate and short service life in the drilling process, and thus are difficult to meet the special construction requirements of horizontal directional drilling.

SUMMARY

An object of the present invention is to provide a double-walled drill pipe and a drilling machine including the double-walled drill pipe.

A first aspect of the present invention provides a double-walled drill pipe, which includes an outer drill pipe, an inner drill pipe and a drill pipe sealing apparatus.

The outer drill pipe includes an axial through hole and a wall surface through hole, and the wall surface through hole is disposed in a wall surface of the outer drill pipe to connect the outside of the double-walled drill pipe and the axial through hole;

The inner drill pipe is rotatably disposed in the axial through hole; and

The drill pipe sealing apparatus is disposed between the outer drill pipe and the inner drill pipe to seal a gap between the outer drill pipe and the inner drill pipe. The drill pipe sealing apparatus is axially located between a driving end of the double-walled drill pipe and a connecting port of the wall surface through hole connected to the axial through hole. The inner drill pipe includes a fluid guiding hole extending from a drilling end of the double-walled drill pipe to the driving end, and the wall surface through hole is connected to the fluid guiding hole.

In some embodiments, the outer drill pipe includes an outer transmission shaft segment located at the driving end and an outer drill pipe segment located at the drilling end. The drill pipe sealing apparatus is disposed between the outer transmission shaft segment and the inner drill pipe, and the wall surface through hole is disposed in the outer drill pipe segment.

In some embodiments, the outer drill pipe includes an outer transmission shaft segment located at the driving end and an outer drill pipe segment located at the drilling end, and the outer transmission shaft segment is threadedly connected to the outer drill pipe segment.

In some embodiments, the inner drill pipe includes an inner transmission shaft segment located at the driving end and an inner drill pipe segment located at the drilling end. The drill pipe sealing apparatus is disposed between the inner transmission shaft segment and the outer drill pipe, and the fluid guiding hole is disposed in the inner drill pipe segment.

In some embodiments, the inner drill pipe includes an inner transmission shaft segment located at the driving end and an inner drill pipe segment located at the drilling end, and the inner transmission shaft segment is inserted into the inner drill pipe segment.

In some embodiments, the double-walled drill pipe includes a first bearing and a second bearing. The first bearing and the second bearing are disposed between the outer drill pipe and the inner drill pipe, and are located at the driving end.

In some embodiments, a driving end of the outer drill pipe is provided with an oil passage, and the oil passage is configured to inject lubricating oil into the first bearing and the second bearing.

In some embodiments, the double-walled drill pipe includes a flange. The flange is fixedly connected to an end surface of a driving end of the outer drill pipe, and abuts against an end surface of a driving end of the inner drill pipe. The outer periphery of the inner drill pipe includes a shaft shoulder located at the drilling end. The axial through hole of the outer drill pipe includes a first step surface located at the drilling end, and the shaft shoulder fits with the first step surface.

In some embodiments, the fluid guiding hole includes an axial blind hole disposed in the inner drill pipe and a radial connecting hole connected to the axial blind hole, and the wall surface through hole is connected to the axial blind hole through the radial connecting hole.

In some embodiments, the drill pipe sealing apparatus includes a first sealing structure and a second sealing structure, and the first sealing structure and the second sealing structure are disposed axially at an interval. The outer drill pipe includes an observation hole, and the observation hole is disposed in the wall surface of the outer drill pipe to connect the outside of the double-walled drill pipe and the axial through hole, and a connecting port of the observation hole connected to the axial through hole is axially located between the first sealing structure and the second sealing structure.

In some embodiments, the drill pipe sealing apparatus includes a baffle ring disposed between the first sealing structure and the second sealing structure, and the baffle ring is provided with a perforation connected to the observation hole.

A second aspect of the present invention provides a drilling machine including the double-walled drill pipe of any embodiment of the first aspect of the present invention.

Based on the double-walled drill pipe and drilling machine provided by the present invention, during an operation of the double-walled drill pipe, the wall surface through hole as a fluid entry channel is connected to a high-pressure fluid source, and the high-pressure fluid is injected into the fluid guiding hole and between the inner drill pipe and the outer drill pipe through the wall surface through hole to drive the drill bit to achieve drilling. The drill pipe sealing apparatus prevents the fluid from flowing upward to avoid affecting the driving end structure (e.g., bearings), thereby improving operational reliability. In addition, the service life of the double-walled drill pipe and the driving end structure connected to the double-walled drill pipe can be prolonged.

Other features and advantages of the present invention will become apparent from the following detailed description of exemplary embodiments of the present invention with reference to the drawings.

BRIEF DESCRIPTION OF THE DRAWINGS

The drawings illustrated herein are used to provide a further understanding for the present invention and form a part of the present application. The exemplary embodiments of the present invention as well as the illustrations thereof are used to explain the present invention and do not constitute an improper limitation of the present invention. In the drawing:

FIGURE is a schematic diagram of the structure of a double-walled drill pipe according to an embodiment of the present invention.

DETAILED DESCRIPTION OF THE EMBODIMENTS

The technical solutions in the embodiments of the present invention will be clearly and completely described below in conjunction with the drawings in the embodiments of the present invention. Obviously, the described embodiments are only part of the embodiments of the present invention, but not all of the embodiments. The following description of at least one exemplary embodiment is in fact merely illustrative and is in no way intended to limit the present invention and its application or use. Based on the embodiments of the present invention, all other embodiments obtained by those having ordinary skill in the art without exerting creative effort shall fall within the scope of protection of the present invention.

Unless otherwise specified, the relative arrangement, numerical expressions and numerical values of components and steps illustrated in these embodiments do not limit the scope of the present invention. Meanwhile, it should be understood that for ease of description, the dimensions of respective parts shown in the drawings are not drawn according to actual scale. Techniques, methods and devices known to those having ordinary skill in the relevant art may not be discussed in detail, but where appropriate, the techniques, methods and devices should be regarded as a part of the claimed description. In all the examples shown and discussed herein, any specific value should be interpreted as exemplary only and not as a limitation. Thus, other examples of the exemplary embodiment may have different values. It should be noted that similar reference numerals and letters denote similar items in the following figures, and thus, once a certain item is defined in one figure, it is not necessary to further discuss it in the subsequent figures.

In the description of the present invention, it should be understood that the words "first", "second" and the like are used to define components only for the purpose of distinguishing the corresponding components. Unless otherwise stated, the above words have no special meaning and thus cannot be understood as limitations to the scope of protection of the present invention.

In the description of the present invention, it should be understood that, orientation or positional relationships indicated by orientation words such as "front, back, up, down, left, right", "lateral, vertical, perpendicular, horizontal" and "top, bottom" are generally based on the orientation or positional relationships shown in the drawings, only for ease of description of the present invention and simplification of the description. In the absence of an explanation to the contrary, these orientation words do not indicate or imply that the apparatus or element referred to must have a specific orientation or be constructed and operated in a specific orientation, and thus cannot be construed as limitations to the scope of the present invention. The orientation words "inside, outside" refer to the inside and outside relative to the profile of each component itself.

FIGURE is a schematic diagram of the structure of a double-walled drill pipe according to an embodiment of the present invention. As shown in FIGURE, the double-walled drill pipe of the embodiment includes the outer drill pipe 1, the inner drill pipe 2 and the drill pipe sealing apparatus 3.

As shown in FIGURE, the outer drill pipe 1 includes an axial through hole and the wall surface through hole 12A, and the wall surface through hole 12A is disposed in a wall surface of the outer drill pipe 1 to connect the outside of the double-walled drill pipe and the axial through hole. The inner drill pipe 2 is rotatably disposed in the axial through hole. The wall surface through hole 12A may be, for example, a radial through hole.

The drill pipe sealing apparatus 3 is disposed between the outer drill pipe 1 and the inner drill pipe 2 to seal the gap between the outer drill pipe 1 and the inner drill pipe 2. The drill pipe sealing apparatus 3 is axially located between a driving end (connected to the driving apparatus, the upper end in FIGURE) of the double-walled drill pipe and a connecting port of the wall surface through hole 12A connected to the axial through hole. The inner drill pipe 2 includes a fluid guiding hole extending axially from a drilling end (connected to a drill bit, the lower end in FIGURE) of the double-walled drill pipe to the driving end, and the wall surface through hole 12A is connected to the fluid guiding hole.

As shown in FIGURE, the fluid guiding hole can include, for example, the axial blind hole 13A disposed in the inner drill pipe 2 and the radial connecting hole 13B connected to the axial blind hole 13A, and the wall surface through hole 12A is connected to the axial blind hole 13A through the radial connecting hole 13B.

During an operation of the double-walled drill pipe, the wall surface through hole 12A as a fluid entry channel is connected to a high-pressure fluid source, and the high-pressure fluid is injected into the fluid guiding hole and between the inner drill pipe 2 and the outer drill pipe 1 through the wall surface through hole 12A to drive the drill bit to achieve drilling. The drill pipe sealing apparatus 3 prevents the fluid from flowing upward to avoid affecting the driving end structure (e.g., bearings), thereby improving operational reliability. In addition, the service life of the double-walled drill pipe and the driving end structure connected to the double-walled drill pipe can be prolonged.

The high-pressure fluid is, for example, water or mud. The drill bit connected to the double-walled drill pipe is, for example, a roller bit.

As shown in FIGURE, in some embodiments, the outer drill pipe 1 includes the outer transmission shaft segment 4 located at the driving end and the outer drill pipe segment 12 located at the drilling end.

The drill pipe sealing apparatus 3 is disposed between the outer transmission shaft segment 4 and the inner drill pipe 2, and the wall surface through hole 12A is disposed in the outer drill pipe segment 12.

In the embodiment shown in FIGURE, the outer transmission shaft segment 4 is threadedly connected to the outer drill pipe segment 12. Different parts of the outer drill pipe 1 are connected through threads, which can bear relatively large torque, push-pull force and hole wall friction force.

As shown in FIGURE, in some embodiments, the inner drill pipe 2 includes the inner transmission shaft segment 5 located at the driving end and the inner drill pipe segment 13 located at the drilling end.

The drill pipe sealing apparatus 3 is disposed between the inner transmission shaft segment 5 and the outer drill pipe 1. The fluid guiding hole is disposed in the inner drill pipe segment 13.

As shown in FIGURE, the inner transmission shaft segment 5 is inserted into the inner drill pipe segment 13. The inserting structure is simple to process and convenient to disassemble. Each part of the inner drill pipe 2 can be inserted, for example, by means of a hexagonal joint.

As shown in FIGURE, the double-walled drill pipe includes the first bearing 7 and the second bearing 8. The first bearing 7 and the second bearing 8 are disposed between the outer drill pipe 1 and the inner drill pipe 2 and are located at the driving end. In order to lubricate the first bearing 7 and the second bearing 8 to prolong the service life of the first bearing 7 and the second bearing 8, the driving end of the outer drill pipe 1 is provided with the oil passage 4B and the oil passage 4B is configured to inject lubricating oil for the first bearing 7 and the second bearing 8.

In order to realize axial positioning between the outer drill pipe 1 and the second inner drill pipe 2, the double-walled drill pipe includes the flange 6. The flange 6 is fixedly connected to an end surface of the driving end of the outer drill pipe 1, and abuts against an end surface of the driving end of the inner drill pipe 2. The outer periphery of the inner drill pipe 2 includes a shaft shoulder located at the drilling end. The axial through hole of the outer drill pipe 1 includes a first step surface located at the drilling end, and the shaft shoulder fits with the first step surface.

The first bearing 7 and the second bearing 8 are disposed axially at an interval. In order to axially position the first bearing 7, as shown in FIGURE, in some embodiments, the flange 6 abuts against an end portion of the first bearing 7. The inner periphery of the axial through hole of the outer drill pipe 1 is provided with a second step surface corresponding to the first bearing 7, and the first bearing 7 abuts against the second step surface, so that the first bearing 7 is axially limited by the flange 6 and the second step surface. In order to axially limit the second bearing 8, as shown in FIGURE, the inner periphery of the axial through hole of the outer drill pipe 1 is provided with a third step surface corresponding to the second bearing 8. One end of the second bearing 8 adjacent to the driving end abuts against the third step surface, and the other end of the second bearing 8 adjacent to the drilling end abuts against the drill pipe sealing apparatus 3, so that the second bearing 8 is axially limited by the drill pipe sealing apparatus 3 and the third step surface.

The flange 6 may be fixedly connected to the end surface of the driving end of the outer drill pipe 1 by a bolt.

As shown in FIGURE, the drill pipe sealing apparatus 3 includes the first sealing structure 11 and the second sealing structure 9, and the first sealing structure 11 and the second sealing structure 9 are disposed axially at an interval. The outer drill pipe 1 includes the observation hole 4A, and the observation hole 4A is disposed in the wall surface of the outer drill pipe 1 to connect the outside of the double-walled drill pipe and the axial through hole. The connecting port of the observation hole 4A connected to the axial through hole is axially located between the first sealing structure 11 and the second sealing structure 9. The first sealing structure 11 and the second sealing structure 9 may be, for example, a single-layer or multiple-layer rubber seal ring. The observation hole 4A is a radial through hole in an embodiment.

In an embodiment, the first sealing structure 11 is adjacent to the drilling end and is in direct contact with high-pressure fluid, so it is prone to be damaged. When the first sealing structure 11 is damaged, the high-pressure fluid will enter between the first sealing structure 11 and the second sealing structure 9. In this case, the observation hole 4A can be used to observe whether the double-walled drill pipe leaks at the drill pipe sealing apparatus 3 and the severity of the leakage to determine whether the first sealing structure 11 is damaged and the degree of damage, so as to timely repair. Meanwhile, the second sealing structure 9 can prevent the high-pressure fluid from entering the driving end when the first sealing structure 11 is damaged.

As shown in FIGURE, the drill pipe sealing apparatus 3 includes the baffle ring 10 disposed between the first sealing structure 11 and the second sealing structure 9, and the baffle ring 10 is provided with a perforation connected to the observation hole 4A. The baffle ring 10 can ensure the axial interval between the first sealing structure 11 and the second sealing structure 9, thereby facilitating timely observation of leakage of the high-pressure fluid by the observation hole 4A when the first sealing structure 11 is damaged.

As shown in FIGURE, the drill pipe sealing apparatus 3 is located between the second bearing 8 and an end portion of the inner drill pipe segment 13, thereby achieving axial positioning.

According to the above description, it can be seen that, in addition to the aforementioned advantages, the double-walled drill pipe according to an embodiment of the present invention has at least one of the following advantages: simple and durable structure, convenient maintenance, reduced manufacturing cost, and improved construction efficiency.

According to an embodiment of the present invention, a drilling machine including the aforementioned double-walled drill pipe is further provided. The drilling machine of the embodiment of the present invention has the corresponding advantages of the double-walled drill pipe.

The double-walled drill pipe and drilling machine of embodiments of the present invention are suitable for a variety of drilling needs, such as trenchless horizontal directional drilling machines.

Finally, it should be noted that the above embodiments are only used to illustrate the technical solution of the present invention and not to limit it. Although the present invention has been described in detail with reference to preferred embodiments, it should be understood by those skilled in the art that modifications may still be made to the specific embodiments of the present invention or equivalent replacements may still be made to some technical features without departing from the spirit of the technical solution of the present invention, all of these modifications and equivalent replacements shall fall within the scope of the claimed technical solution of the present invention.

What is claimed is:

1. A double-walled drill pipe, comprising:

an outer drill pipe, wherein the outer drill pipe comprises an axial through hole and a wall surface through hole, wherein the wall surface through hole is disposed in a wall surface of the outer drill pipe to connect an outside of the double-walled drill pipe and the axial through hole;

an inner drill pipe, wherein the inner drill pipe is rotatably disposed in the axial through hole; and a drill pipe sealing apparatus, wherein the drill pipe sealing apparatus is disposed between the outer drill pipe and the inner drill pipe to seal a gap between the outer drill pipe and the inner drill pipe; the drill pipe sealing apparatus is axially located between a driving end of the double-walled drill pipe and a connecting port of the wall surface through hole connected to the axial through hole; the inner drill pipe comprises a fluid guiding hole extending from a drilling end of the double-walled drill pipe, and the wall surface through hole is connected to the fluid guiding hole, wherein the outer drill pipe comprises an outer transmission shaft segment located at the driving end and an outer drill pipe segment located at the drilling end; the drill pipe sealing apparatus is disposed between the outer transmission shaft segment and the inner drill pipe, and the wall surface through hole is disposed in the outer drill pipe segment.

2. The double-walled drill pipe of claim 1, wherein the outer transmission shaft segment is threadedly connected to the outer drill pipe segment.

3. The double-walled drill pipe of claim 1, wherein the inner drill pipe comprises an inner transmission shaft segment located at the driving end and an inner drill pipe segment located at the drilling end; the drill pipe sealing apparatus is disposed between the inner transmission shaft segment and the outer drill pipe, and the fluid guiding hole is disposed in the inner drill pipe segment.

4. The double-walled drill pipe of claim 1, wherein the inner drill pipe comprises an inner transmission shaft segment located at the driving end and an inner drill pipe segment located at the drilling end, and the inner drill pipe segment is inserted into the inner transmission shaft segment.

5. The double-walled drill pipe of claim 1, wherein the double-walled drill pipe comprises a first bearing and a second bearing; the first bearing and the second bearing are disposed between the outer drill pipe and the inner drill pipe, and the first bearing and the second bearing are located at the driving end.

6. The double-walled drill pipe of claim 5, wherein a driving end of the outer drill pipe is provided with an oil passage, and the oil passage is configured to inject a lubricating oil into the first bearing and the second bearing.

7. The double-walled drill pipe of claim 5, wherein the double-walled drill pipe comprises a flange; the flange is fixedly connected to an end surface of a driving end of the outer drill pipe, and the flange abuts against an end surface of a driving end of the inner drill pipe; an outer periphery of the inner drill pipe comprises a shaft shoulder located at the drilling end; the axial through hole of the outer drill pipe comprises a first step surface located at the drilling end, and the shaft shoulder fits with the first step surface.

8. The double-walled drill pipe of claim 1, wherein the fluid guiding hole comprises an axial blind hole disposed in the inner drill pipe and a radial connecting hole connected to the axial blind hole, and the wall surface through hole is connected to the axial blind hole through the radial connecting hole.

9. The double-walled drill pipe of claim 1, wherein the drill pipe sealing apparatus comprises a first sealing structure and a second sealing structure, wherein the first sealing structure and the second sealing structure are disposed axially at an interval; the outer drill pipe comprises an observation hole, wherein the observation hole is disposed in the wall surface of the outer drill pipe to connect the outside of the double-walled drill pipe and the axial through hole; a connecting port of the observation hole connected to the axial through hole is axially located between the first sealing structure and the second sealing structure.

10. The double-walled drill pipe of claim 9, wherein the drill pipe sealing apparatus comprises a baffle ring disposed between the first sealing structure and the second sealing structure, and the baffle ring is provided with a perforation connected to the observation hole.

11. A drilling machine, comprising the double-walled drill pipe of claim 1.

12. The drilling machine of claim 11, wherein the outer drill pipe comprises an outer transmission shaft segment located at the driving end and an outer drill pipe segment located at the drilling end; the drill pipe sealing apparatus is disposed between the outer transmission shaft segment and the inner drill pipe, and the wall surface through hole is disposed in the outer drill pipe segment.

13. The drilling machine of claim 11, wherein the outer drill pipe comprises an outer transmission shaft segment located at the driving end and an outer drill pipe segment located at the drilling end, and the outer transmission shaft segment is threadedly connected to the outer drill pipe segment.

14. The drilling machine of claim 11, wherein the inner drill pipe comprises an inner transmission shaft segment located at the driving end and an inner drill pipe segment located at the drilling end; the drill pipe sealing apparatus is disposed between the inner transmission shaft segment and the outer drill pipe, and the fluid guiding hole is disposed in the inner drill pipe segment.

15. The drilling machine of claim 11, wherein the inner drill pipe comprises an inner transmission shaft segment located at the driving end and an inner drill pipe segment located at the drilling end, and the inner transmission shaft segment is inserted into the inner drill pipe segment.

16. The drilling machine of claim 11, wherein the double-walled drill pipe comprises a first bearing and a second bearing; the first bearing and the second bearing are disposed between the outer drill pipe and the inner drill pipe, and the first bearing and the second bearing are located at the driving end.

17. The drilling machine of claim 16 wherein a driving end of the outer drill pipe is provided with an oil passage, and the oil passage is configured to inject a lubricating oil into the first bearing and the second bearing.

18. The drilling machine of claim 16, wherein the double-walled drill pipe comprises a flange; the flange is fixedly connected to an end surface of a driving end of the outer drill pipe, and the flange abuts against an end surface of a driving end of the inner drill pipe; an outer periphery of the inner drill pipe comprises a shaft shoulder located at the drilling end; the axial through hole of the outer drill pipe comprises a first step surface located at the drilling end, and the shaft shoulder fits with the first step surface.

19. The drilling machine of claim 11, wherein the fluid guiding hole comprises an axial blind hole disposed in the inner drill pipe and a radial connecting hole connected to the axial blind hole, and the wall surface through hole is connected to the axial blind hole through the radial connecting hole.

* * * * *